US006791505B2

(12) United States Patent
Zaitsev

(10) Patent No.: US 6,791,505 B2
(45) Date of Patent: Sep. 14, 2004

(54) METHOD FOR INCREASING EFFECTIVE HEIGHT OF A COMPACT ANTENNA ASSEMBLY, METHOD FOR ENSURING DIRECTIONAL EFFECT OF THE COMPACT ANTENNA ASSEMBLY AND COMPACT ANTENNA ASSEMBLIES FOR CARRYING OUT SAID METHODS

(75) Inventor: Georgy Mikhailovich Zaitsev, Moscow (RU)

(73) Assignee: Advanced Micro Antennas LLC, McLean, VA (US)

( * ) Notice: Subject to any disclaimer, the term of this patent is extended or adjusted under 35 U.S.C. 154(b) by 0 days.

(21) Appl. No.: 10/399,712

(22) PCT Filed: Sep. 3, 2001

(86) PCT No.: PCT/RU01/00360

§ 371 (c)(1),
(2), (4) Date: Apr. 21, 2003

(87) PCT Pub. No.: WO02/33787

PCT Pub. Date: Apr. 25, 2002

(65) Prior Publication Data

US 2004/0027294 A1 Feb. 12, 2004

(30) Foreign Application Priority Data

Oct. 19, 2000 (RU) ..... 2000126318

(51) Int. Cl.[7] ..... H01Q 7/08

(52) U.S. Cl. ..... 343/788; 343/748

(58) Field of Search ..... 343/701, 787, 343/788, 712, 713, 860, 866, 867, 700 MS, 748

(56) References Cited

U.S. PATENT DOCUMENTS

| | | | | |
|---|---|---|---|---|
| 3,852,760 A | | 12/1974 | Reggia | |
| 6,097,271 A | * | 8/2000 | Kozakoff | 333/204 |
| 6,121,940 A | * | 9/2000 | Skahill et al. | 343/860 |
| 6,163,305 A | | 12/2000 | Murakami et al. | |
| 6,552,696 B1 | * | 4/2003 | Sievenpiper et al. | 343/909 |
| 6,633,257 B2 | * | 10/2003 | Ito | 342/368 |

FOREIGN PATENT DOCUMENTS

| | | |
|---|---|---|
| DE | 199 24 022 A1 | 12/1999 |
| EP | 1 044 926 A2 | 10/2000 |

* cited by examiner

*Primary Examiner*—James Vannucci
*Assistant Examiner*—Minh Dieu A
(74) *Attorney, Agent, or Firm*—Burns, Doane, Swecker & Mathis, L.L.P.

(57) ABSTRACT

A radio technology can be used for developing compact antenna assemblies for various uses. The compact antenna assembly includes and oscillatory circuit including a reactive component (8) and an inductance coil. The reactive component (8) is embodied in the form of a condenser provided with a pair of metallic plates (11). A space between the plates is filled with a material (9) containing particles (10) of conducting material separated by a dielectric filling material. The distance between the plated (11) is chosen such that it is less than $\lambda/4$, where $\lambda$ is wave length actuating signals.

31 Claims, 5 Drawing Sheets

METHOD FOR INCREASING EFFECTIVE HEIGHT OF A COMPACT ANTENNA ASSEMBLY, METHOD FOR ENSURING DIRECTIONAL EFFECT OF THE COMPACT ANTENNA ASSEMBLY AND COMPACT ANTENNA ASSEMBLIES FOR CARRYING OUT SAID METHODS

FIELD OF THE INVENTION

The invention relates to radio engineering, in particular—to wave-systems, and can be suitably used for designing small-size antenna devices of diverse applications.

Emission and absorption of the electromagnetic wave energy using the known antenna devices can be carried out optimally when dimensions of an antenna are equal to, or multiple of quarter of wavelength of the emitted or received signal. In the real practice of construction of antenna devices it is often necessary to reduce the antenna dimensions, especially for their operation on low frequencies, and provide the directional effect of an antenna.

These goals are achieved using the known techniques of lengthening of antennas and construction of sophisticated directional effect antennas.

BACKGROUND OF THE INVENTION

A technique for lengthening of antennas is discussed below basing on the example of conventional vibrator 1 performing the role of an antenna having length l and oriented along axis z (FIG. 1). Generator 2 of harmonic oscillations provides pumping of current I(ω t) into an antenna. Distribution of current along the antenna corresponds to I(z). Such antenna is characterised by parameter h of the antenna effective height:

$$h=(\int I(z)dz)/I_o(1) \quad (1)$$

where $I_o$ is operating value of the current at antenna pedestal.

When $l=\lambda/4$, where λ is wavelength of the emitted signal, it follows from (1) that $$h=(2/\pi)/l=\lambda/2\pi=h_{opt} \quad (2)$$

i.e. the effective height of antenna, $h_{opt}$, in the optimum case is 0.637 of the actual height l.

FIG. 1*b* shows the spatial distribution of the electric and magnetic fields of vibrator 1.

If $l<\lambda/4$ (shortened antenna), then $h<h_{opt}$, said inequality being maintained also using the techniques of artificial lengthening of antennas, shown in FIGS. 2*a, b, c* that illustrate, respectively, antenna 3 of T-type, antenna 4 of Γ-type, antenna 5 that has an additional inductance L at its pedestal. Such antenna lengthening techniques allow to provide the optimal distribution of current I(z) along an antenna. As regards the effective height h, for antennas 3 and 4 of T- and Γ-types, when $l<\lambda/4$, h=1, i.e. it is equal to the height of an antenna itself; and in case of antenna 5 having an additional inductance L (FIG. 2*c*): h=l/2, i.e. the effective height is equal to half the antenna height.

Power of emission of dipole antennas is known to be determined by the following ratio:

$$P=(k\,h^2 I_o^2)/\lambda^2 \quad (3)$$

where k≈1600. Value of $(k\,h^2)/\lambda^2$ is the effective resistance $r_{ef}$ of an antenna. Emission resistance $r_{em}\approx 2r_{ef}$. If $l=\lambda/4$, i.e. $h=h_{opt}$, then $r_{ef}\approx 40$ Ohm.

If $l<\lambda/4$, then, as it is obvious from expression (3), the emission resistance drops sharply ($r_{ef}\equiv h^2$). Thus, for example, when $h=(1/3)\,h_{opt}$, then resistance $r_{ef}$ decreases almost ten times. When $l<<\lambda/4$, then $r_{em}$ is negligible and, consequently, to provide a predetermined value of $P_{em}$, current $I_o$ must be very strong, which results in difficulties in practical realisation. Further, a significant difference of value of $r_{ef}$ from the optimum value sharply reduces the possibility to match an antenna with a feeder path.

The directional effect of antennas is known to be provided by an appropriate spatial arrangement of a number of antenna elements. At that, the optimum value of $P_{em}$ is achieved when the distance between the antenna elements is multiple of λ/4. Such arrangement also provides a required phase shift in separate antenna elements (vibrators), when in their spatial combination the passive antenna elements are present. FIG. 3*a* shows a diagram of arrangement of symmetrical half-wave vibrator 6 and reflector 7 in plane (x, z), and FIG. 2*b* shows pattern of such antenna in plane (x, y)

Thus, a decrease in the solid angle of propagation of the antenna-emitted (or received) electromagnetic energy (antenna gain) involves an increase in dimensions of an antenna system, which often results in serious technical problems in designing communication devices, in particular in case of the necessity to use signals in a relatively long-wave range Hence, the objective of the invention consists in providing an antenna device that will be free of said drawbacks of the known antennas and provide a possibility to increase the antenna effective height, with small dimensions of a device and decreased dimensions in the wave propagation direction for the directional effect antennas

SUMMARY

More specifically, the objective of the invention consists in providing an antenna device wherein the nature of the electrodynamic processes effected therein will ultimately result in an increase in the effective resistance, i e an increase in the effective height, and, furthermore, the nature of the spatial-temporal distribution of electromagnetic field in such antenna device will provide directionality of propagation of the emitted waves, with electrical interrelationship between an antenna device and passive vibrators at the distances much less than λ/4

The technical result to be attained is a significant growth of the antenna device emission resistance, and, consequently, an increase in the antenna effective height with dimensions of $l<\lambda/4$ and $l<<\lambda/4$, and a possibility to create a directional effect antenna device having the dimensions, in the direction of predominant propagation of the emitted and absorbed electromagnetic waves, that are much less than quarter of wavelength Said technical result is achieved as follows in a method of increasing the effective height of a small-size antenna device, according to the invention, formed is an antenna element in the form of an oscillating loop consisting of a reactive element and inductance coil that are connected in series, inductance value of which coil being selected such that to provide resonance of the oscillating loop at a predetermined frequency of a signal; the reactive element being provided in the form of a capacitor having a pair of metallic plates, the space between said plates being filled with a material containing particles of a conductive substance, which particles are separated by a dielectric filler, the distance between the capacitor plates being selected to be less than value λ/4, where λ is wavelength of the signals acting on the antenna device, the conductive substance being selected such that to meet the following conditions:

$$(\omega\rho^2\epsilon\mu/x_o)\cdot 10^{-11} \geqq 1,\ (1/\rho\omega)\ 10^{10} >> \epsilon,$$

where $\omega$ is frequency of the operating signal; $\rho$ is specific conductance of the conductive substance (Ohm·m); $\epsilon$, $\mu$ are, respectively, relative electric and magnetic permeabilities of a medium; $x_o$ is the least one of dimensions of cross-section of a conductive substance particle, which cross-section is perpendicular to direction of the acting electric field vector, (cm);

to the oscillating loop applied a signal, which signal causes a loop voltage to develop across the reactive element and brings about the loop voltage electric field in the space that surrounds the reactive element; thereby, in the signal transmission mode, provided is accumulation of the applied signal energy in the reactive element material, which accumulation is caused by the electrodynamic interaction of said material and electromagnetic field of the operating signal, with subsequent transformation of the accumulated energy into that of the emitted electromagnetic field in the proximate zone of the antenna device; and a flux of emission of electromagnetic power is formed;

and in the signal reception mode provided is absorption of the energy flux of the external electromagnetic field, which absorption is caused by interaction of said external electromagnetic field with electric field of the loop voltage in the proximate zone of the antenna device, with subsequent accumulation of the supplied energy in the reactive element material and its transformation into the received signal energy.

Further, the capacitor plates area is determined such that to provide a required value of electric capacity, with the proviso of a predetermined value of the antenna device frequency transmission bandwidth, with regard to the known values of the operating signal frequency and the distance between the capacitor plates, the spatial orientation of the antenna device being determined such that the polarisation vector of the electric field of the emitted or received electromagnetic waves will be perpendicular to the capacitor plates' planes.

As the material to fill the space between the capacitor plates, an high-frequency ferrite or ion-containing liquid are selected.

Said technical result is also attained in a small-size antenna device intended to realise said method, and comprising an antenna element in the form of an oscillating loop that includes a reactive element implemented as a capacitor, as discussed above, and an inductance coil and also a feeder; the capacitor, inductance coil and feeder being connected in series.

Said device can further comprise a second inductance coil, first leads of both inductance coils being connected to the feeder, second ones being connected to corresponding capacitor plates.

In another embodiment, the device can further comprise a second reactive element implemented in the form of a capacitor identical to the first reactive element, first plates of the first and second capacitors being connected to the feeder, second plates of the capacitors being connected to corresponding leads of the inductance coil, a coaxial cable being used as the feeder.

Said technical result is also achieved in a method for providing the directional effect of a small-size antenna device, according to which method: formed is an antenna element in the form of an oscillating loop consisting of a reactive element and inductance coil that are connected in series, inductance value of which coil is selected such that to provide resonance of the oscillating loop at a predetermined signal frequency; the reactive element being provided in the form of a capacitor having a pair of metallic plates, the space between said plates being filled with a material containing particles of a conductive substance, which particles are separated by a dielectric filler, the distance between the capacitor plates being selected to be less than value $\lambda/4$, where $\lambda$ is wavelength of the signals acting on the antenna device, the conductive substance being selected such that to meet the following conditions:

$$(\omega\rho^2\epsilon\mu/x_o)\cdot 10^{-11} \geqq 1,\ (1/\rho\omega)\ 10^{10} >> \epsilon,$$

where $\omega$ is frequency of the operating signal; $\rho$ is specific conductance of the conductive substance material (Ohm·m); $\epsilon$, $\mu$ are, respectively, relative electric and magnetic permeabilities of a medium; $x_o$ is the least one of dimensions of cross-section of a conductive substance particle, which cross-section is perpendicular to direction of the acting electric field vector, (cm);

the oscillating loop is connected to the feeder, an additional antenna element is connected to one of the feeder's conductors at a distance from the reactive element, which distance is much less that quarter of wavelength; to the oscillating loop applied is a signal, which signal causes a loop voltage to develop across the reactive element and brings about the loop voltage electric field in the space that surrounds the reactive element and additional antenna element that alters the loop voltage electric field symmetry; and formed is an antenna pattern that is asymmetrical in respect of the coordinate axes due to breaking of the loop voltage electric field symmetry.

Further, the additional antenna element, having length of the order of quarter of wavelength or half of wavelength of the operating signal, is connected to one of the feeder conductors at a distance from the reactive element, which distance is of the order of 0.1 of quarter of wavelength.

The small-size antenna device according to this method comprises an oscillating loop that includes: a reactive element implemented in the form of a capacitor, as mentioned above, an additional antenna element implemented as mentioned above and disposed in the immediate vicinity of the oscillating loop; and a feeder, the capacitor, inductance coil and feeder being connected in series, and the additional antenna element being connected to one of the feeder conductors at a distance from the reactive element, which distance is much less than quarter of wavelength In devising the invention, the author assumed that said objective could be achieved, in principle, using only the antenna elements wherein the electrodynamic processes in their internal structure would provide appearance of efficient electromotive forces coinciding with, or acting in antiphase with respect to the current flowing through said elements Such action of said electromotive force for an extended element having length l results in either an additional take-off of energy from a generator that creates current in said element, or in an increased value of the absorbed energy from the ambient space In other words, this electrodynamic process is equivalent to an increase in resistance of emission $r_{em}$ of an antenna having length l when $l<\lambda/4$, or $l<<\lambda/4$.

The author ascertained that an increase in power of electromagnetic oscillations (signals) emitted (or absorbed) by a spatially extended element having length l is provided when therein active are the electromotive forces caused by interrelationship between parameters of the internal material structure of an element itself and those of electromagnetic fields of external sources' signals The effect of this electrodynamic process is an increase in resistance of emission $r_{em}$ of an antenna, when $l<\lambda/4$ or $l<<\lambda/4$ As a result of theoretical investigations and experiments, the author ascertained that in conductive bodies, when they are subjected to action of external electromagnetic fields, under the condition that $\sigma/\omega>>\epsilon_{rel}$, where $\sigma$ is specific conductance of a conductor expressed in Gauss system of units, $\omega$ is frequency of oscillations of said waves, $\epsilon_{rel}$ is relative electric permeability of a medium, an efficient electromotive force of interrelationship between a field and medium $U^{\sim}$ appears and is expressed as follows $$U^{\sim}=(q\epsilon\mu/\sigma^2 x_o)\cdot\partial U/\partial t \quad (4)$$

where q is the dimension factor, $\epsilon\mu$ are, respectively, electric and magnetic permeabilities of a medium (in SI system of units $\epsilon=\epsilon_{rel}\epsilon_o$: $\mu_{rel}\,\mu_o$, where $\epsilon_{rel}$, $\mu_{rel}$ are relative electric and magnetic permeabilities of a medium; $\epsilon_o$, $\mu_o$ are electric and magnetic constants; o, is specific conductance of a conductor, $x_o$ is the least one of dimensions of the conductive element cross-section, which cross-section is perpendicular to the direction of the vector that acts on an electric field conductor.

As a result of analysis of expression (4) the conclusion can be made as to what features the wave-system element should possess so that to achieve the set objective. Expression (4) demonstrates that an effective exhibition of $U^{\sim}$ will be higher with greater values of $\epsilon$ and $\mu$ of the material of a given element and with lesser value of its specific conductance $\sigma$. Dependence of $U^{\sim}$ $(1/x_o)$ ascertains the fact of the spatial isolation of this element from other similar elements in directions of Pointing vector S=[EH]. Further, such element must provide the possibility of passage of current I(t) owing to action of electric oscillation generator.

It was found that for meeting said requirements, an antenna device is to comprise an element made of a material with a fine-grained structure, whose grain parameters will satisfy the conditions defined by expression (4) and in which structure the grains themselves having dimensions of the order of $x_0$ will be separated by a dielectric material, i.e. said element should be essentially a capacitor, i.e. a reactive element of a circuit, between metallic plates of which capacitor said fine-grained material is disposed, and the plates themselves also perform the function of the current collectors.

BRIEF DESCRIPTION OF THE DRAWINGS

The invention is explained by its exemplary embodiments, shown in the accompanying drawings, wherein:

FIGS. 4*a, b, c* represent examples of possible embodiments of reactive element 8, source of effective electromotive force $U^{\sim}$. As FIGS. 4*a, b, c* illustrate: reactive element 8 is essentially an electric capacitor having dielectric filler 9 that binds, in a contactless manner, grains 10 of a conductive material having linear dimensions of the order of $x_o$ in a volume V=l·S, where l is length, S is area of the base of the geometric figure having volume V. On end faces of element 8, at distance l, metallic plates 11 having area S are arranged. As the materials that consist of dielectric filler 9 binding conductive material grains 10, various types of high-frequency ferrites or liquid solutions, wherein a liquid serves as a binding dielectric and ions of solved substances perform the function of the conductive particles, can be used Such structure satisfactorily operates when the condition of $1/\sigma\geqq10^2$ Ohm·m is satisfied FIGS. 5*a, b, c, d* illustrate embodiments of antenna devices according to the invention. According to FIG. 5*a*, reactive element 8 is connected in series to inductance coil 12 thus constituting an oscillating loop that is connected to feeder 13

Figure 5:
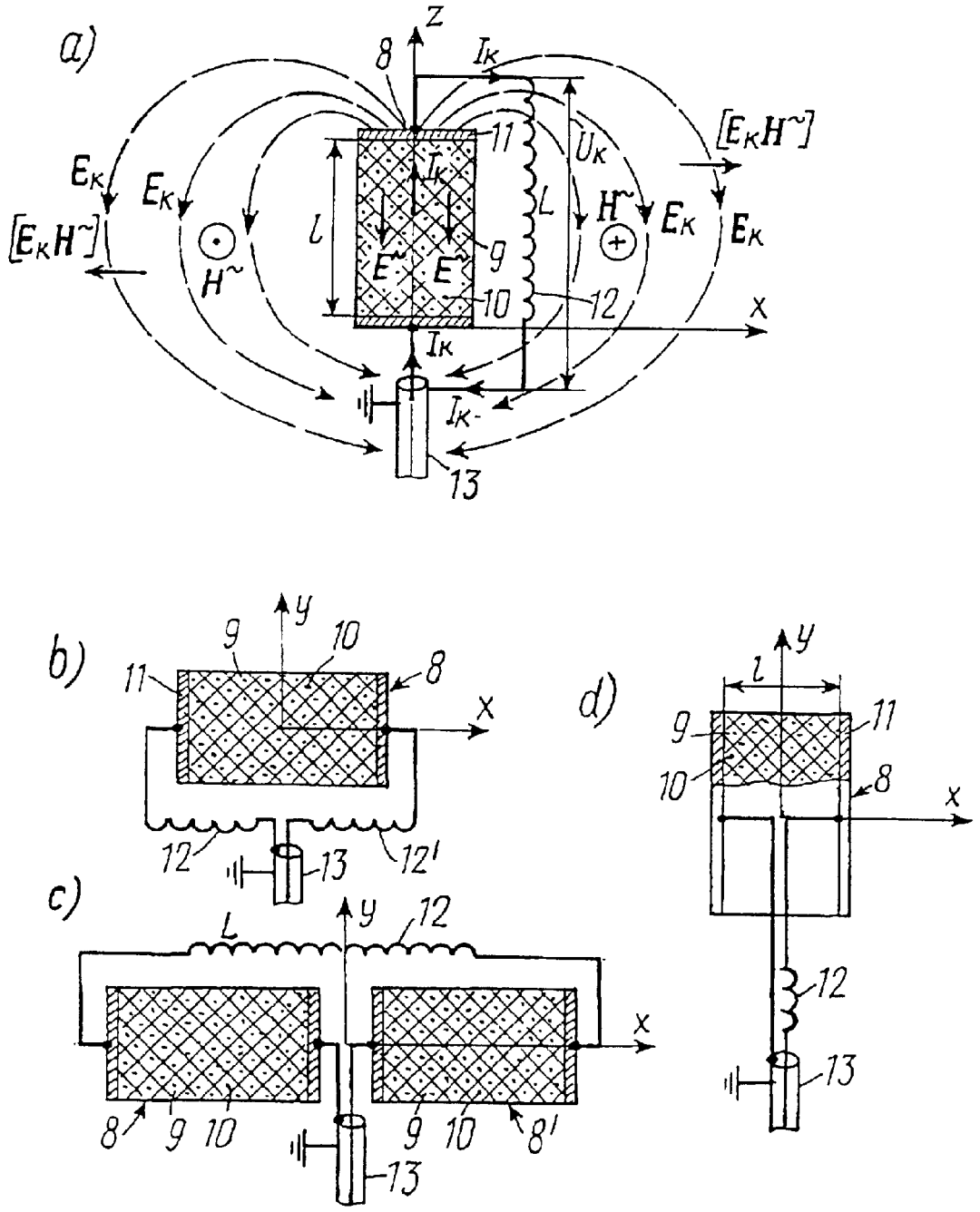
FIGS. 5*b*, 5*c* show the same oscillating loop in the version of the symmetrical connection, the embodiment according to FIG. 5*b* employing two identical inductance coils 12, 12', and the embodiment according to FIG. 5*c* uses two reactive elements 8, 8
' FIG. 5*d* shows the embodiment of an asymmetric loop having inductance coil 12 disposed out of the zone of action of the reactive element 8 field.

According to FIG. 5*a*, reactive element 8, as a capacitor having capacity C, is comprised by an in-series loop having, apart from reactive element 8, inductance L denoted by reference numeral 12. Size l of reactive element 8 is oriented along axis z. Loop CL is tuned to resonance with frequency $\omega$ of signal U(t) supplied via feeder 13; and loop current $I_{lo}(t)$ flows through the in-series circuit C, L. Loop voltage $U_{lo}(t)$ developed across reactive element 8 and loop current $I_o(t)$ at resonant frequency $\omega_r=1/\sqrt{LC}$ are in phase quadrature. Thereat, as follows from expression (4), efficient electromotive force $U^{\sim}(t)$ is also in phase quadrature with respect to $U_{lo}(t)$ and acts in the opposite direction to current $I_o(t)$ (accumulation effect). As a result, resistance of the in-series loop CL increases, i.e. load $z_{lo}$ of feeder 13 increases. Product $U^{\sim}(t)\cdot I_{lo}(t)=P^{\sim}(t)$ determines the power transmitted by feeder 13 into reactive element 8 of loop CL.

Figure 1:
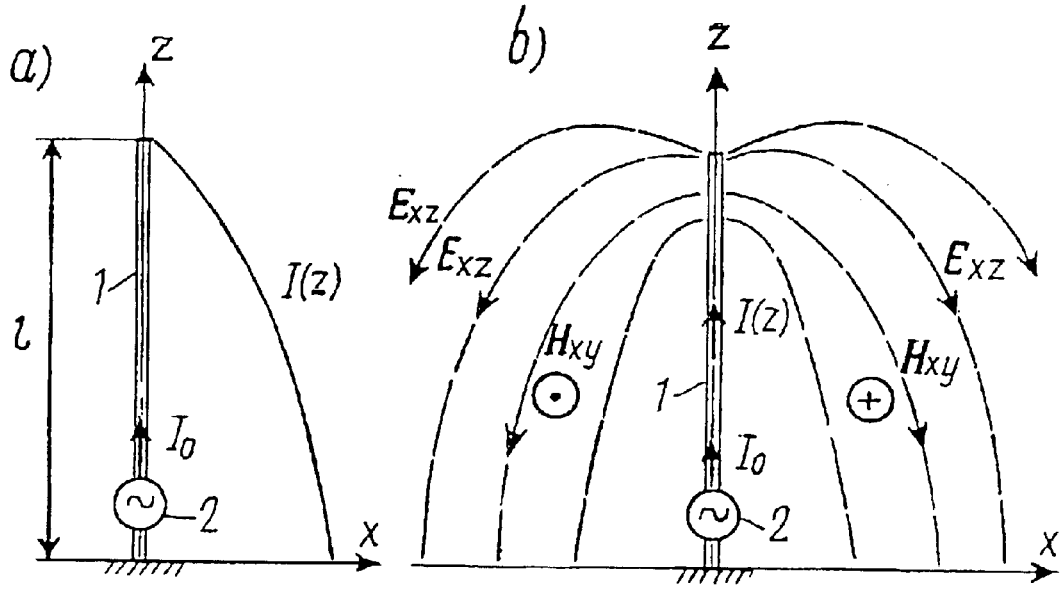
FIG. 1—vertical rectilinear antenna of the prior art, and distribution of current therein, FIG. 2*b*—spatial distribution of fields in the antenna shown in FIG. 1*a,*
Figure 2:
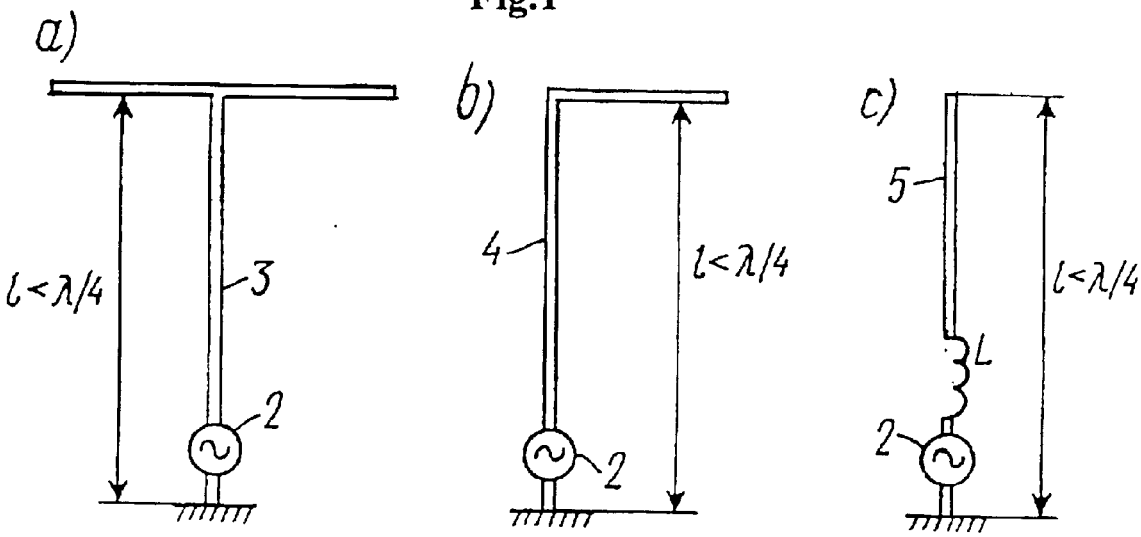
FIGS. 2*a, b, c*—versions of antennas, wherein the known methods for lengthening of antennas, when $l<\lambda/4$, are realised FIG. 3*a*—a known antenna having the directed characteristic of emission, FIG. 3*b*—pattern of the antenna according to FIG. 3*a,*
Figure 3:
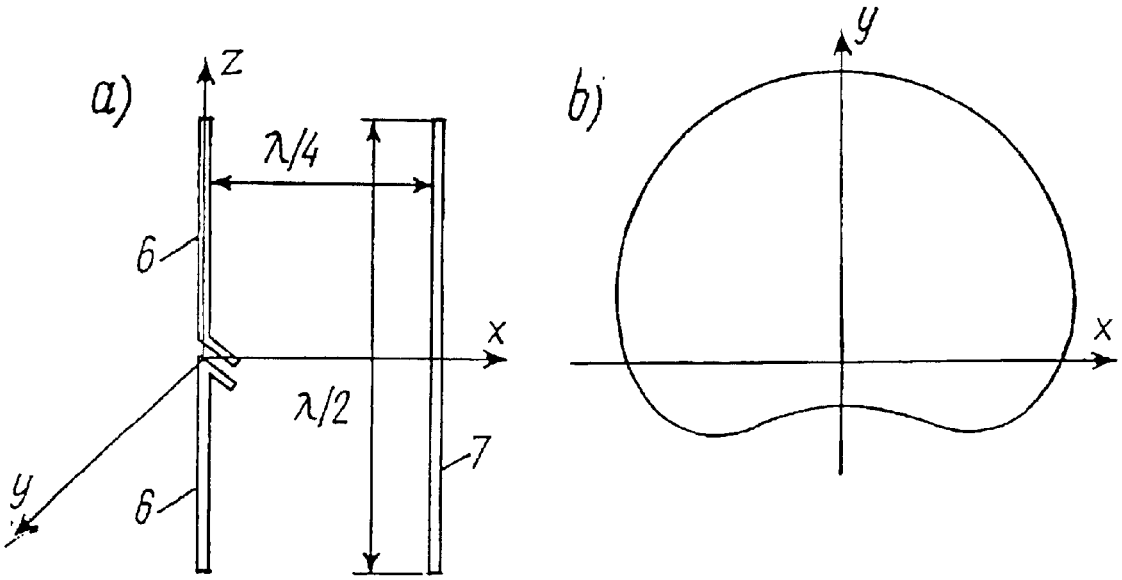
Figure 4:
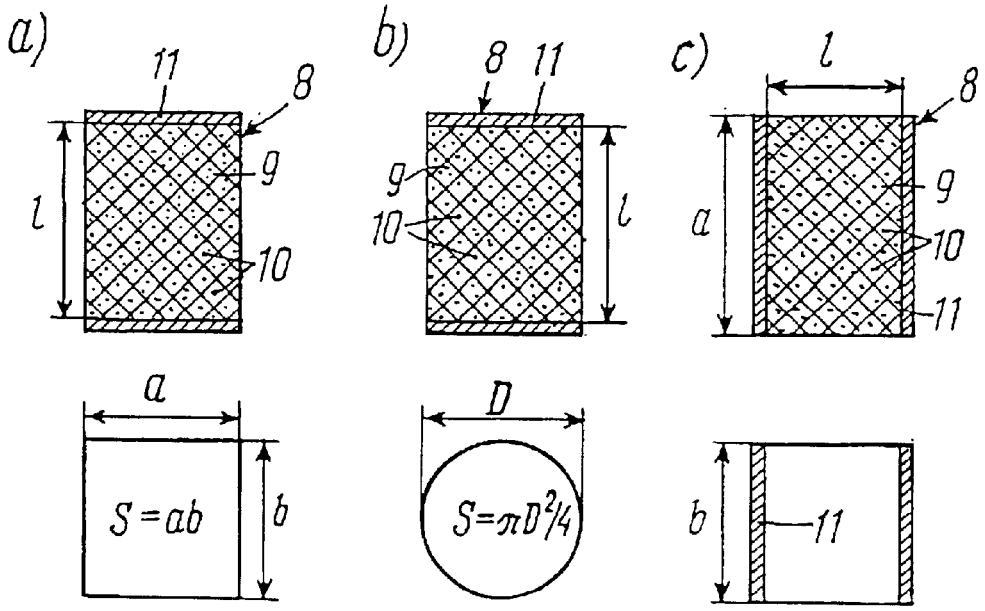
FIGS. 4*a, b, c*—embodiments of a reactive element that is the source of efficient electromotive force $U^{\sim}$, according to the invention, FIGS. 5*a, b, c*—embodiments of the antenna devices according to the invention, FIG. 6—embodiments of the directional effect antenna devices according to the invention, FIG. 7—patterns of the antenna devices according to FIG. 6.

It is obvious that current $I_{lo}(t)$ under the conditions of a conventional loop, due to different directions of its flow through elements C and L, in contrast to current I(z) in a classic vibrator (FIG. 1*b*), does not create the magnetic field in plane (x, y) that includes the whole loop. But appearance of efficient electromotive force $U^{\sim}(t)$, i.e. field $E_z=E^{\sim}=U^{\sim}(t)$ t/l in reactive element 8 results in appearance of magnetic field $H^{\sim}_{ef}$ that includes CL loop in plane (x, y), according to Maxwell equation:

$$\text{rot}\, H^{\sim}_{ef}=\epsilon\partial E^{\sim}/\partial t \quad (5)$$

It follows from expression (5) that phase $H^{\sim}_{ef}(t)$ along the time axis coincides with phase of voltage $U_{lo}(t)$, i.e. that of field $E_{lo}(t)$, already in the proximate zone of the space surrounding CL loop, which means that $\text{div}[E_{lo}H^{\sim}_{ef}]$ during a period of oscillations $I_{lo}(t)$ is other than zero, hence the power emitted by loop CL, as by an antenna, is other than zero and determined by the following ratio:

$$P_{cm}=_v\int \text{div}[E_{lo}H^{\sim}_{ef}]=\int[E_{lo}H^{18}_{ef}]ds \quad (6)$$

where s is the area that includes the emitting loop CL, $P_{cm}=r_{ef}\cdot I_o^2$ is the power emitted by an antenna device.

Thus, when dimensions of the reactive element are $<\lambda/4$ and $l<<\lambda/4$, appearance of efficient electromotive force $\bar{U}(t)$ results in an increase in value of $r_{em}$ and, consequently, increases the effective height of the antenna device that includes reactive element 8.

Further, the effect of implementation of the reactive element according to the invention as discussed above, is that the formation of the radiation flux div $[E_{lo}\bar{H}_{ef}]$ in the proximate zone of loop CL, i.e. that of reactive element 8, provides the possibility to obtain the directional emission of such antenna device without a significant increase in its dimensions in the direction of the maximum emitted power. This increase is feasible, because the spatial distribution of field $E_{lo}$ is defined by geometry of loop CL.

Figure 6:
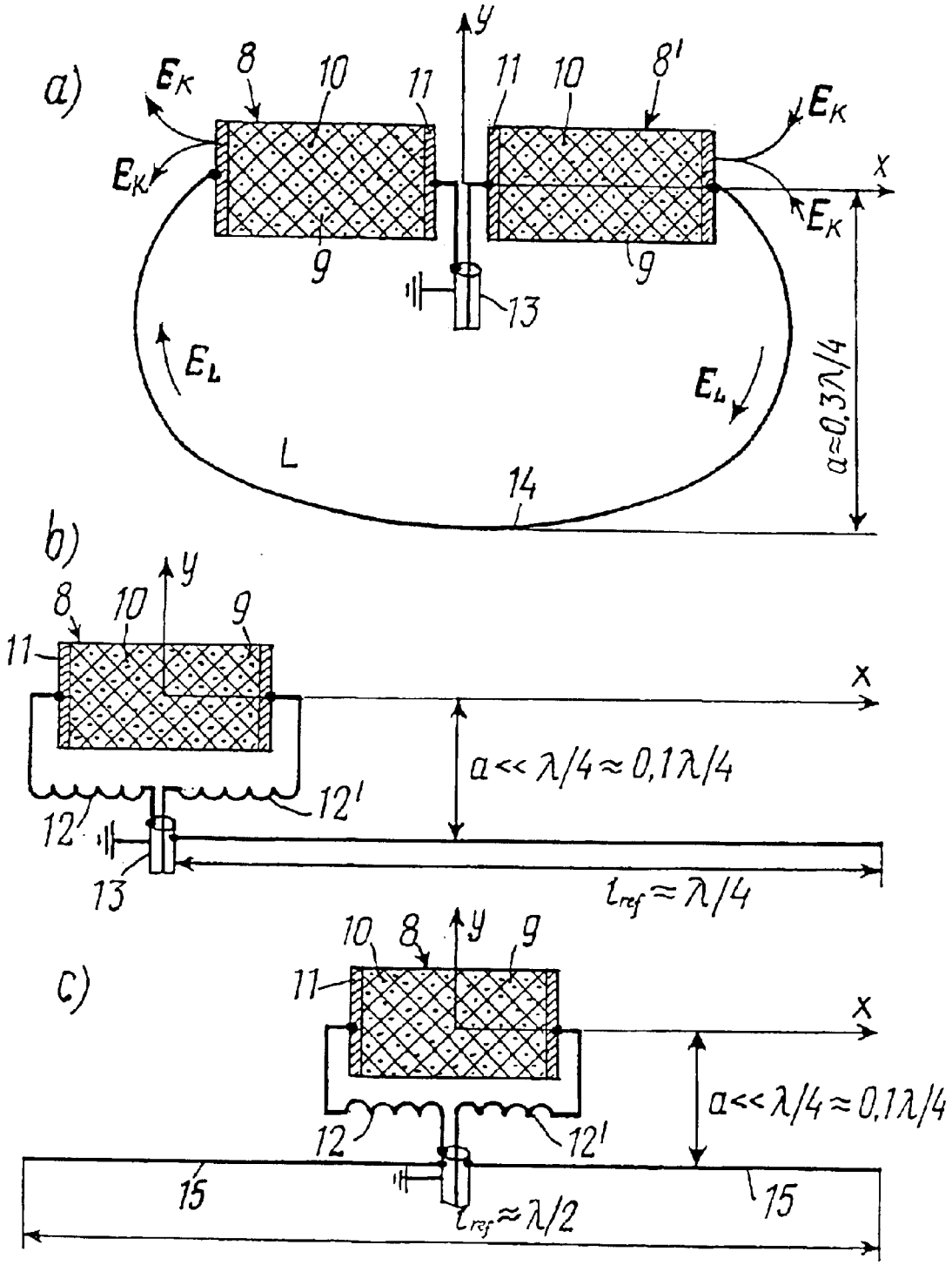

FIGS. 6*a, b, c* show versions of antenna devices comprising reactive element 8 and having patterns that are different from the circular one.

Figure 7:
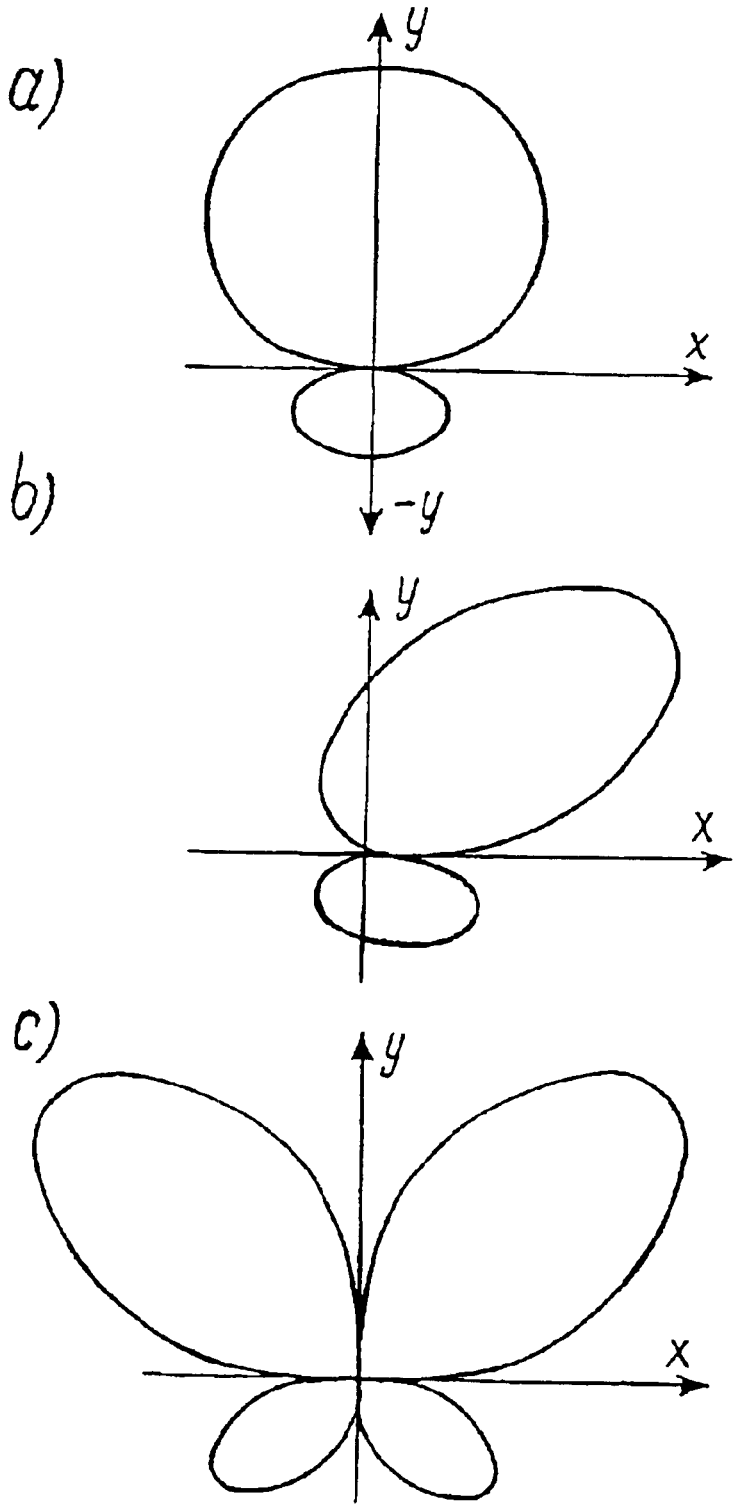

FIG. 6*a* shows an antenna device implemented in the form of an oscillating loop in the version of the symmetrical connection (FIG. 5*c*), comprising two reactive elements 8, 8'; and inductance L can be implemented as frame 14 having dimensions of the order of 0.3 $\lambda/4$. Electromotive force of self-induction L dt/dt creates electric field $E_L$ directed opposite to action of field $E_{lo}$, and for that reason Pointing vector [EH] in the direction of axis (−y) is weakened. Pattern of such antenna device is shown in FIG. 7*a*.

FIG. 6*b* shows an antenna device, comprising an oscillating loop that includes reactive element 8, as capacitor C, and inductance coils 12, 12', which loop is connected to output of a coaxial feeder; an further comprising additional vibrator 15 that has length $l_{ref}\approx\lambda/4$, is connected to an external conductor (braid) of the coaxial feeder and disposed at the distance of $a\approx 0.1\ \lambda/4$ from reactive element 8. In contrast to the asymmetrical connection of additional vibrator 15 in embodiment according to FIG. 6*b*, the version of an antenna device shown in FIG. 6*c* comprises symmetrically connected vibrator 15 having length $l_{ref}\approx\lambda/2$ Formation of flux [EH] in this complex coupled loop, wherein vibrator 15 acts as a constituent of the loop, occurs unevenly along axis y both in the asymmetrical (FIG. 6*b*) and symmetrical (FIG. 6*c*) versions of connection of vibrator 15. Patterns of antenna devices according to FIGS. 6*b* and 6*c* are represented, respectively, in FIGS. 7*b* and 7*c*.

The antenna devices, as implemented according to the invention and comprising means for forming the directed emission, allow to obtain standing-wave ratio of the order of 1.1÷1.2, with various values of length l of reactive element 8 of the order of 0.1 $\lambda/4$. An additional advantage of these antenna devices is the circumstance that therein loop CL, as the load, self-matches with wave impedance of feeder 13.

The band of transmitted frequencies in the antenna devices according to the invention is determined by selection of values of capacity C of reactive element 8 by way of varying its dimensions.

The antenna devices according to the invention are capable of operating with a feeder being a coaxial cable, without the need to take measures for symmetrization of connecting an antenna to a coaxial cable.

Versions of the antenna devices according to the invention are able of becoming widely applicable in the field of designing radio engineering devices of various purposes in communication systems, the radio detection and ranging applications, etc. Thus, for example, the version of the claimed antenna device as illustrated in FIG. 6*b* can be used in mobile communication radiotelephones, wherein methods of protecting a user against hazardous levels of the transmitted signal power (FIG. 7*b*) are employed.

Experimental designs of the proposed antenna devices were tested within the range of operating frequencies 10 MGz to 15 GGz both in the transmission and reception modes As the material for reactive elements, the industrial brands of high-frequency ferrites and various aqueous solutions were used The obtained results correspond to the above-recited performance data of the antenna devices according to the invention.

What is claimed is:

1. A method for increasing the effective height of a small-size antenna device, comprising the steps of forming an antenna element in the form of an oscillating loop consisting of a reactive element and inductance coil that are connected in series, inductance value of which coil being selected such that to provide resonance of the oscillating loop at a signal predetermined frequency;

the reactive element being provided in the form of a capacitor having a pair of metallic plates, the space between said plates being filled with a material containing particles of a conductive substance, which particles are separated by a dielectric filler, the distance between the capacitor plates being selected to be less than $\lambda/4$, where $\lambda$ is wavelength of the signals acting on the antenna device, the conductive material being selected such that to meet the following conditions:

$$(\omega\rho^2\epsilon\mu/x_o)\cdot 10^{-11}\geqq 1,\ (1/\rho\omega)\ 10^{19}>>\epsilon,$$

where $\omega$ is frequency of the operating signal; $\rho$ is specific conductance of the conductive substance (Ohm·m); $\epsilon$, $\mu$ are, respectively, relative electric and magnetic permeabilities of a medium; $x_o$ is the least one of dimensions of cross-section of a conductive substance particle, which cross-section is perpendicular to direction of the acting electric field vector, (cm);

applying a signal to the oscillating loop, which signal causes a loop voltage to develop across the reactive element and brings about the loop voltage electric field in the space that surrounds the reactive element;

thereby, in the signal transmission mode, provided is accumulation of the applied signal energy in the reactive element material, which accumulation is caused by the electrodynamic interaction of said material and electromagnetic field of the operating signal, with subsequent transformation of the accumulated energy into that of the emitted electromagnetic field in the proximate zone of the antenna device, and a flux of emission of electromagnetic power is formed;

and in the signal reception mode provided is absorption of the energy flux of the external electromagnetic field, which absorption is caused by interaction of said external electromagnetic field with electric field of the loop voltage in the proximate zone of the antenna device, with subsequent accumulation of the supplied energy in the reactive element material and its transformation into the received signal energy.

2. The method as claimed in claim 1, characterised in that the area of capacitor plates is determined such that to provide a required value of electric capacity, with a predetermined value of the frequency transmission bandwidth provided by the antenna device, with regard to the known values of the operating signal frequency and the distance between the capacitor plates.

3. The method as claimed in claim 2, characterised in that the spatial arrangement of the antenna device is determined such that the polarisation vector of the electric field of the emitted or received electromagnetic waves is perpendicular to the capacitor plates' planes.

4. The method as claimed in claim 1, wherein a high-frequency ferrite is selected as the material for filling the space between the capacitor plates.

5. The method according to claim 1, wherein an ion-containing liquid is selected as the material to fill the space between the capacitor plates.

6. A small-size antenna device, comprising:

an antenna element in the form of an oscillating loop, including a reactive element implemented in the form of a capacitor having a pair of metallic plates, the space between said metallic plates being filled with a material containing particles of a conductive substance, which particles are separated by a dielectric filler, the space between the capacitor plates being selected to be less than value $\lambda/4$, where $\lambda$ is wavelength of the signals that act on the antenna device; the conductive substance being selected such that the following conditions will be satisfied:

$$(\omega\rho^2\epsilon\mu/x_o)\cdot 10^{-11} \geqq 1,\ (1/\rho\omega)\ 10^{19} >> \epsilon,$$

where $\omega$ is frequency of the operating signal; $\rho$ is specific conductance of the conductive material (Ohm·m); $\epsilon$, $\mu$ are, respectively, relative electric and magnetic permeabilities of a medium; $x_o$ is the least one of dimensions of cross-section of a conductive substance particle, which cross-section is perpendicular to direction of the acting electric field vector, (cm);

an inductance coil, a feeder, the capacitor, inductance coil and feeder being connected in series.

7. The device according to claim 6, characterised in that the spatial orientation of the antenna device is determined such that the polarisation vector of the electric field of the emitted and received electromagnetic waves is perpendicular to the planes of the capacitor plates.

8. The device according to claim 7, characterised in that the capacitor plates area is determined such that to provide a required value of capacity with a predetermined value of the frequency transmission bandwidth provided by the antenna device, with regard to the known values of the operating signal frequency values and the distance between the capacitor plates.

9. The device according to claim 6, further comprising a second inductance coil, first leads of both inductance coils being connected to the feeder, second leads being connected to corresponding capacitor plates.

10. The device according to claim 6, further comprising a second reactive element implemented in the form of a capacitor, which second reactive element is identical to the first one, first plates of the first and second capacitors being connected to the feeder, and second plates of the capacitors being connected to corresponding inductance coil leads.

11. The device according to claim 6, wherein a high-frequency ferrite is selected as the material for filling the space between the capacitor plates.

12. The device according to claim 6, wherein an ion-containing liquid is selected as the material for filling the space between the capacitor plates.

13. The device according to claim 6, wherein a coaxial cable is used as the feeder.

14. A method for providing the directional effect of a small-size antenna device, comprising the steps of:

forming an antenna element in the form of an oscillating loop consisting of a reactive element and inductance coil that are connected in series, inductance value of which coil being selected such that to provide resonance of the oscillating loop at a signal predetermined frequency; the reactive element being provided in the form of a capacitor having a pair of metallic plates, the space between said plates being filled with a material containing particles of a conductive substance, which particles are separated by a dielectric filler, the distance between the plates being selected to be less than value $\lambda/4$, where $\lambda$ is wavelength of the signals acting on the antenna device, the conductive substance being selected such that to meet the following conditions:

$$(\omega\rho^2\epsilon\mu/x_o)\cdot 10^{-11} \geqq 1,\ (1/\rho\omega)\ 10^{19} >> \epsilon,$$

where $\omega$ is frequency of the operating signal; $\rho$ is specific conductance of the conductive substance material (Ohm·em); $\epsilon$, $\mu$ are, respectively, relative electric and magnetic permeabilities of a medium; $x_o$ is the least one of dimensions of cross-section of a conductive substance particle, which cross-section is perpendicular to direction of the acting electric field vector, (cm);

connecting the oscillating loop to the feeder, connecting an additional antenna element to one of the feeder conductors at a distance from the reactive element, which distance is much less than quarter of wavelength, applying a signal to the oscillating loop, which signal causes a loop voltage to develop across the reactive element and brings about the loop voltage electric field in the space that surrounds the reactive element and additional antenna element altering the loop voltage electric field symmetry, and forming an antenna pattern that is asymmetrical with respect to coordinate axes due to a broken symmetry of the loop voltage electric field.

15. The method as claimed in claim 14, characterised in that the capacitor plates' area is determined such that to insure a required value of the frequency transmission bandwidth provided by the antenna device, with regard to the known values of the operating signal frequency and the distance between the capacitor plates.

16. The method according to claim 14, wherein a high-frequency ferrite is selected as the material for filling the space becween the capacitor plates.

17. The method according to claim 14, wherein an ion-containing liquid is selected as the material for filling the space between the capacitor-plates.

18. The method according to claim 14, wherein a coaxial cable is used as the feeder.

19. The method as claimed in claim 14, wherein the additional antenna element is connected to one of the feeder conductors at a distance from the reactive elements, which distance is of the order of 0.1 of quarter of wavelength.

20. The method as claimed in claim 14, wherein the additional antenna element is selected such that its length is of the order of quarter of the operating signal wavelength.

21. The method as claimed in claim 14, wherein the additional antenna element is selected such that its length is of the order of half the operating signal wavelength.

22. A small-size antenna device, comprising:

an oscillating loop that includes a reactive element implemented in the form of a capacitor having a pair of metallic plates, the space between said plates being filled with a material containing particles of a conductive substance, which particles are separated by a dielectric filler, the distance between the plates being selected to be less than $\lambda/4$, where $\lambda$ is wavelength of the signals acting on the antenna device, the conductive substance being selected such that to meet the following conditions:

$$(\omega\rho^2\epsilon\mu/x_o)\cdot 10^{-11} \geqq 1,\ (1/\rho\omega)\ 10^{19} >> \epsilon,$$

where $\omega$ is frequency of the operating signal; $\rho$ is specific conductance of the conductive substance (Ohm·m); $\epsilon$, $\mu$ are, respectively, relative electric and magnetic permeabilities of a medium; $x_o$ is the least one of dimensions of cross-section of a conductive substance particle, which cross-section is perpendicular to direction of the acting electric field vector, (cm); and an inductance coil, an additional antenna element disposed in the immediate proximity to the oscillating loop, and a feeder, the capacitor, inductance coil and feeder being connected in series, the additional antenna element being connected to one of the feeder conductors at a distance from the reactive element, which distance is much less than quarter of wavelength.

23. The device as claimed in claim 22, characterised in that the capacitor plates' area is determined such that to ensure the frequency transmission bandwidth provided by the antenna device, with regard to the known values of the operating signal frequency and the distance between the capacitor plates.

24. The device according to claim 22, further comprising a second inductance coil, first leads of both inductance coils being connected to the feeder, second leads being connected to corresponding capacitor plates.

25. The device according to claim 22, further comprising a second reactive element implemented in the form of a capacitor, which second reactive element is identical to the first one, first plates of the first and second capacitors being connected to the feeder, their second plates being connected to corresponding inductance coil leads.

26. The device according to claim 22, wherein a high-frequency ferrites is selected as the material for filling the space between the capacitor plates.

27. The device according to claim 22, wherein an ion-containing liquid is selected as the material for filling the space between the capacitor plates.

28. The device according to claim 22, wherein a coaxial cable is used as the feeder.

29. The device as claimed in claim 22, wherein the additional antenna element is connected to one of the feeder conductors at a distance from the reactiv element, which distance is of the order of 0.1 of quarter of wavelength.

30. The device as claimed in claim 22, wherein the additional antenna element is selected such that its length is of the order of quarter of the operating signal wavelength.

31. The device as claimed in claim 22, wherein the additional antenna element is selected such that its length is of the order of half the operating signal wavelength.

* * * * *